United States Patent [19]

Pounds et al.

[11] 4,195,210

[45] Mar. 25, 1980

[54] SWITCHING ASSEMBLIES

[75] Inventors: Walter R. Pounds, Lafayette; Bill D. Dunlap, Longmont, both of Colo.

[73] Assignee: KB-Denver, Inc., Frederick, Colo.

[21] Appl. No.: 15,808

[22] Filed: Feb. 27, 1979

[51] Int. Cl.[2] ..... H01H 1/24; H01H 13/52

[52] U.S. Cl. ..... 200/159 A; 200/275; 200/283

[58] Field of Search ..... 200/5 A, 159 A, 159 B, 200/275, 283, 340

[56] References Cited

U.S. PATENT DOCUMENTS

| | | | |
|---|---|---|---|
| 3,673,357 | 6/1972 | Molchan | 200/159 B X |
| 3,796,843 | 3/1974 | Durkee et al. | 200/159 B X |
| 3,928,736 | 12/1975 | Drage | 200/275 X |
| 3,941,964 | 3/1976 | Yoder | 200/275 X |
| 3,967,084 | 6/1976 | Pounds | 200/275 |
| 3,978,297 | 8/1976 | Lynn et al. | 200/340 X |
| 4,029,916 | 6/1977 | Chu | 200/159 B X |
| 4,085,306 | 4/1978 | Dunlap | 200/275 |
| 4,096,364 | 6/1978 | Lynn et al. | 200/5 A |
| 4,156,802 | 5/1979 | Giland et al. | 200/275 X |
| 4,160,886 | 7/1979 | Wright et al. | 200/5 A |

FOREIGN PATENT DOCUMENTS 2424751 12/1975 Fed. Rep. of Germany ..... 200/159 A

*Primary Examiner*—Stephen Marcus

*Attorney, Agent, or Firm*—Hugh H. Drake

[57] ABSTRACT

A switching assembly includes an insulative substrate upon which is carried a plurality of conductive paths respective portions of which are selectively bridged upon depression of a resilient conductive contact element. That contact element is generally in the shape of a dome and has a central region of substantially planar conformation from which the remainder of the dome slants integrally downward and outward to a lower marginal rim portion. The dome-shaped element is disposed adjacent to the substrate with at least a portion of its rim portion electrically and physically contacting one of the portions of one of the paths. The central region is generally in registry over another of the portions in another of the paths so as to enable connection between the central region and that other portion upon depression of the central region.

7 Claims, 8 Drawing Figures

SWITCHING ASSEMBLIES

The present invention relates generally to switching assemblies. More particularly, it is related to a keyboard substrate assembly that carries a plurality of resilient domes each of which may be depressed to close one or more circuits.

As noted in prior U.S. Pat. Nos. 3,967,084 and 4,085,306, assigned to the same assignee as the present application, developments in solid state electronics have led to great reduction in the size of instruments such as calculators and related computational apparatus. In the kind of unit which employs a keyboard to permit input by means of fingertip pushbutton depression, the keyboard assembly has tended to pose at least as much of a limitation upon size reduction of the overall unit as the electronic components which perform the interrelated operations. In furtherance of miniaturization of the keyboard assembly, one general approach implemented by various manufacturers has involved the use of an electrical switch element in the form of a resilient metal dome. The marginal edge of the dome is in electrical contact with a first terminal carried by an insulating substrate, while the center of the dome overlies a second terminal also carried by the substrate. Upon depression of the central region of the dome into contact with the second terminal, a connection is completed between the two terminals.

In its simplest form, such a dome has been a smooth sector of a sphere. One drawback in the use of a simple sphere segment has been its lack of a sufficiently effective tactile feedback. That is, the user has found it difficult to detect through the sense of feel in his fingertip just when actual electrical contact has been made upon depression of a pushbutton which flexes the domes. The same thing is true even when the pushbutton is eliminated and the user presses his fingertip directly against the dome itself. In any case, it has become desirable that the dome exhibit what at least seems to be a snap action. To this end, domes have been developed which include some sort of polygonal, usually triangular, shaping. In some cases, the marginal edge portion of the domes have been cut so as to define a polygonal shape. In another case, the marginal edge of the dome was retained in circular shape but the body of the dome was embossed in a pattern which has a generally triangular shape. In all of those cases, the dome was further embossed or deformed at each of the corners of the polygon so as to form a foot which rested upon a corresponding electrical terminal carried by an insulating substrate. A leading difficulty with those approaches was a decided tendency for mechanical fractures to develop at the edges of the feet. That led to failure of performance of the dome prior to failure of any other component of the associated instrument.

A significant advance appeared with the disclosure in the aforesaid U.S. Pat. No. 3,967,084. Among other important improvements, that patent disclosed the use of only two spaced-opposed feet on the dome. That approach enabled the retention of a significant degree of tactile feedback while improving structural lifetime of the domes. Still further improvements was attained by use of the disclosure in the aforesaid U.S. Pat. No. 4,085,306. In accordance with its teaching, the use of but a single foot on the peripheral margin of the dome not only improved structural lifetime but also enabled the central undersurface of the dome to exhibit sort of a "smearing" action that achieved reliable electrical connection with a plurality of underlying electrode areas.

For many calculator and other computational apparatus, simultaneous connection of multiple circuits may not be of interest. In other implementations of keyboards and the like, however, such multiple connection may be essential. One example is a keyboard for addressing a conventional telephone system with codes and tones as in pushbutton dialing.

For best results in terms of structural lifetime for domes of the kinds disclosed in the reference patents, various grinding or smoothing techniques preferably were employed to creases otherwise formed in the delineation of the feet. Of course, that means the need for manufacturing techniques which has to be employed subsequent to the initial formation of each dome with its included foot or feet. Necessarily, such procedures increased cost, although the cost to lifetime ratio represented a distinct improvement in the art. Nevertheless, the assignee of the aforementioned patents has sought still further improvement.

It is, accordingly, a general object of the present invention to provide a new and improved switching assembly and, particularly, a still-further-improved resilient conductive contact element.

Another object of the present invention is to provide such a contact element which achieves at least the same degree of improvement as attained by use of the approaches of the aforementioned patents but which is more economical to manufacture.

A further object of the present invention is to provide a new and improved contact element that extends structural lifetime while enabling the retention of superior performance in operation.

Still another object of the present invention is to provide a new and improved keyboard assembly for enabling multiple-circuit connections at individual switch sites.

A switching assembly in accordance with one aspect of the present invention includes an insulative substrate upon which is carried a plurality of conductive paths respective portions of which are selectively bridged upon depression of a resilient conductive contact element. The contact element is generally in the shape of a dome but has a central region of substantially planar conformation from which the remainder of the dome slants integrally downward and outward to a lower marginal rim portion. The dome shaped element is disposed adjacent to the substrate with at least a portion of that rim portion being in electrical and physical contact with one of the portions of one of the paths. The central region is generally in registry over another of the portions in another of the paths to enable connection between the central region and that other portion upon depression of the central region.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
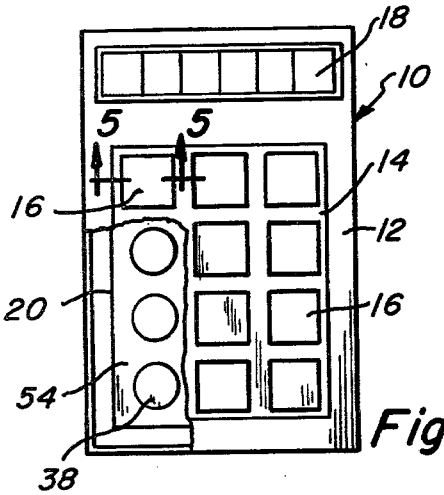
FIG. 1 is a plan view, partially broken away, of a calculator that uses a keyboard assembly of the present invention.
Figure 3:
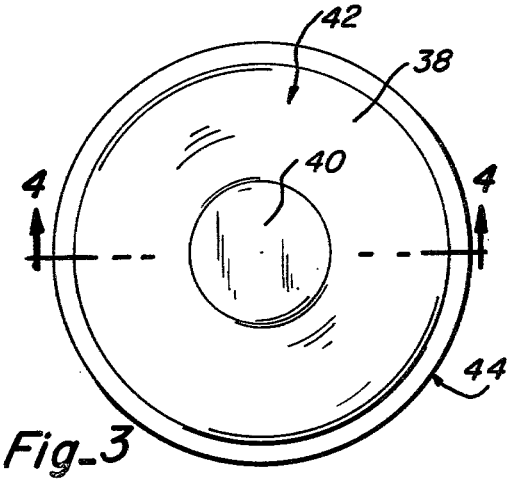
FIG. 3 is a plan view of a component included in the assembly of FIGS. 1 and 2.

An electronic calculator 10 includes a housing 12 which encloses integrated computational circuitry and devices (not shown) and a keyboard assembly. An apertured coverplate 14 positions and captivates a plurality of pushbuttons 16 that individually are marked to indicate respective different functions or parameters. An indicator lamp bank 18 provides visual readout of the results calculated.

For supporting the different electrical elements associated with the keyboard assembly, a substrate 20 is mounted within housing 12. The substrate is formed of a laminate of insulating material. An applicable description thereof will be found in aforesaid U.S. Pat. No. 3,967,084. Consequently, the disclosure in the above-referenced patent relating to the details of the substrate is hereby incorporated by reference.

Figure 6:
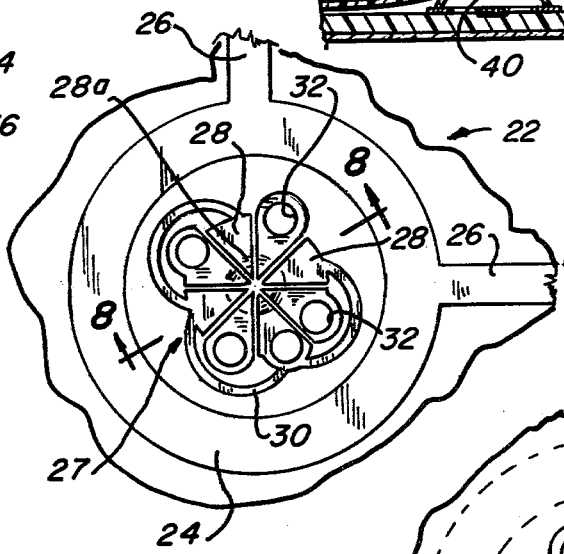
FIG. 6 is an enlarged top plan view of a switch-location portion of the apparatus shown in FIG. 2.

Substrate 20 carries thereon a plurality of electrically conductive leads which terminate at different switch sites 22 with each site having a plurality of terminals or lands. One such switch site is illustrated in FIG. 6 to have an outer circular terminal 24 connected by leads 26 to adjacent outer circular terminals of other switch sites. Within each circular outer terminal 24 is a circular array 27 of generally pie-shaped terminals 28. Terminals 28 are separated from each other so as not to be in electrical contact with each other. Selected ones of the pie-shaped terminals are connected to others of the same by arcuate connecting leads 30. In this case, certain of the pie-shaped terminals also include conductive sleeves 32 that extend through substrate 20 and are connected by leads 34 on the undersurface of substrate 20 in accordance with particular functions to be performed by the calculator device.

The contact layout illustrated is fully described in aforesaid U.S. Pat. No. 4,085,306 which, therefore, also is incorporated herein by reference. Nevertheless, the present invention is not limited in use to any particular layout. For example, there may be only a single central contact and/or outer terminal 24 may be segmented and connected to define a plurality of separate contacts.

Covering each switch site 22 is a dome-shaped resilient contact element 38. Each contact element 38 has a central region 40 which is of substantially planar conformation. The remainder 42 of element or dome 38 slants integrally downward and outward to a lower marginal rim portion 44. Element 38 is disposed adjacent to substrate 20 so that at least a portion of its rim portion 44 is in electrical and physical contact with one of the portions of one of the conductive paths such as circular outer terminal 24. Central region 40 is generally in registry over another of the path portions as represented by any of terminals 28 so as to enable connection, between central region 40 and the plurality of pie sections 28, upon depression of central region 40. Central region 40 presents a relatively broad contact area that, upon depression of region 40, makes electrical (and physical) contact essentially simultaneously with all of pie-shaped terminals 28.

Contact elements or domes 38 are mounted on substrate 20 in registry with and in overlying relationship to switch sites 22. As also taught in the cross-referenced patents, a thin layer of flexible insulating material 54 coated on its underside with a film 56 of a pressure-sensitive adhesive material is laid over substrate 20 and domes 38 to hold those domes in position at their respective switching sites. Preferably included in the layer of material 54 are a plurality of apertures 58 which are distributed in an array that corresponds with the array of the different switch sites on the substrate. Thus, each aperture 58 is aligned to be in registry with the respective different ones of the domes or contace elements 38. However, each of apertures 58 has a diameter which is smaller than the diameter of the associated contact element. On the other hand, the diameter of each aperture 58 preferably is at least as large as the diameter of region 40, so as not to interfere with direct physical contact between region 40 and pushbutton 16.

During assembly, the layer of material 54 is adhesively affixed both to the separate contact elements and to the upper surface of substrate 20 itself. This serves to maintain physical and electrical contact between the lower marginal rim portion 44 and outer terminals 24 on the substrate. On the other hand, apertures 58 permit direct contact of the pushbutton 16 associated with each central region 40 surrounding what otherwise would be the apex of the dome. This serves to retain a high degree of tactile feedback which would be lost if material 54 were permitted to extend continuously across the centers of the various contact elements.

Figure 2:
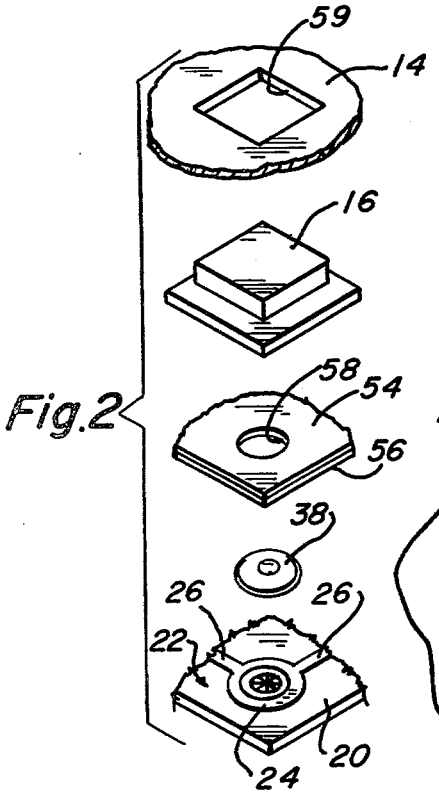
FIG. 2 is an exploded perspective view of a fragmentary portion of the apparatus included in FIG. 1.
Figure 4:
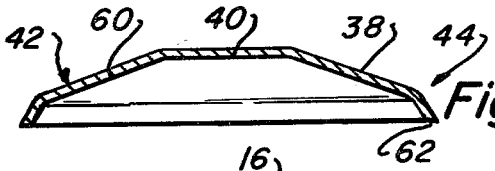
FIG. 4 is a cross-sectional view taken along the line 4—4 in FIG. 3.
Figure 5:
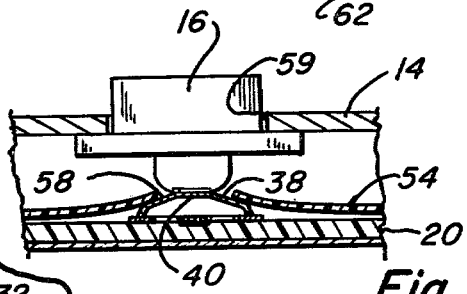
FIG. 5 is a cross-sectional view taken along the line 5—5 in FIG. 1.

FIG. 2 best illustrates the relationship of each contact element or dome 38 to its respective switch site 22 on the underlying substrate 20, the covering layer of material 54, the associated pushbutton 16 and the overlying coverplate 14 which holds the pushbuttons in place. Coverplate 14 has openings 59 therein which mate with the respective pushbuttons so that the latter are in registry over apertures 58 in layer 54 as well as in registry with regions 40 of elements 38. Upon depression of any one contact element 38, region 40 is pushed downwardly so as to make a broad and essentially simultaneous contact with each of pie-shaped terminals 28 that are disposed at the switching site.

Figure 8:
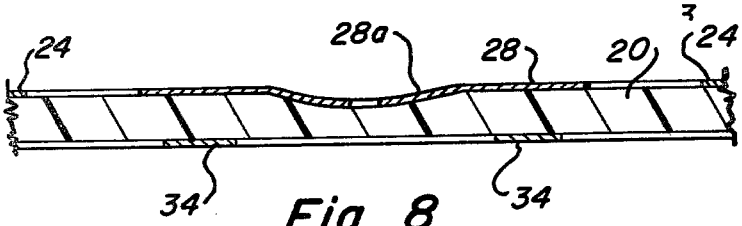
FIG. 8 is a fragmentary cross-sectional view taken along the line 8—8 in FIG. 6.
Figure 7:
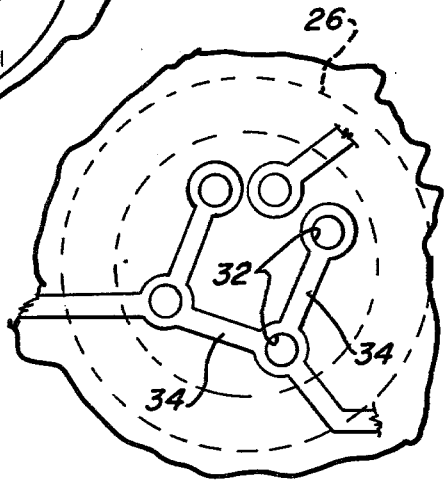
FIG. 7 is a fragmentary bottom plan view of a switch location as shown in FIG. 6.

For best results in achieving essentially simultaneous and certain contact between a dome and its underlying central conductive areas, it has been found best to "spank" the contacted conductive areas underlying dome region 40 in a manner such that those conductive areas are at the same level relative to region 40. To smooth out any irregularities in the plating or other formation of the conductive areas as well as any irregularities in the insulative substrate, it has been found to be desirable to depress the central portion of the underlying conductive areas as shown in FIG. 8. In one proven approach, involving domes as hereinafter detailed as to dimensions, the central portion **28*a* of terminals 28, after formation of terminals 28 on substrate 20, is pressed or struck with a die having a smooth, blunt downwardly-convex face that has a radius of 0.750 inch. The center depth of the depression is 0.002 inch as measured from the original exterior surface of terminals 28**.

The key to the success of the present dome is believed to be the provision of the planar or flat-topped central region 40. Conceptually, the remainder of the dome need only be a segment of a sphere the lower marginal edge of which extends into contact with a conductor on the substrate. On the other hand, the preferred embodiment involves shaping the dome to include an annular intermediate portion 60 which is in itself of a flat shape but slants away from central region 40 at a first angle and then merges into rim portion 44 that, in turn, slants with respect to central region 40 at a second angle greater than the first angle. As herein illustrated, rim portion 44 defines a foot 62 that continues entirely around the lowermost margin of dome 38.

In particular embodiments that proved to be successful, domes 38 were variously employed in different keyboard assemblies that required that they have 0.270, 0.350 or 0.5 inch diameters. In each case, the material of which dome 38 was formed was hard stainless steel of 0.003 inch thickness. The height of the dome from the bottom of foot 62 to the upper surface of central region 40 was 0.014 inch. Intermediate portion 60 slanted down from the plane defined by central region 40 at an angle of eight degrees. The diameter of the flat area defined by central region 40 was 0.080 inch. The lower marginal rim portion 44 is further slanted down at a greater angle of approximately forty-five degrees to the plane defined by central region 40.

As shown in the preferred embodiment which is illustrated, rim portion 44 constitutes a foot that continues entirely around the lowermost margin of dome 38. It is contemplated, however, that such rim portion may instead be formed to define one or more distinct feet as taught by the aforementioned patents which are incorporated herein by reference. A modification in that direction should still further increase tactile feedback, although it might result in some reduction in ultimate lifetime of use as compared with the preferred version which is illustrated. In whatever form, lifetimes may be increased even further by smearing out any creases as taught in the aforesaid U.S. Pat. No. 3,967,084. However, it appears that the disclosed structure is so efficacious that additional techniques of that sort become unnecessary as a practical matter.

The invention has been specifically illustrated in connection with a calculator-type instrument. As already indicated, however, it is applicable to other implementations such as in keyboards for addressing coded signals. In whatever usage, pushbutton 16 may be eliminated as such. In one adaptation, dome 38 may be actuated by direct physical contact of the user's fingertip. In a modified adaptation, a flexible film may cover the surface of dome 8 presented to the user.

While a particular embodiment of the invention has been shown and described, and various alternatives have been taught, it will be obvious to those skilled in the art that changes and modifications may be made without departing from the invention in its broader aspects. Therefore, the aim in the appended claims is to cover all such changes and modifications as fall within the true spirit and scope of the invention.

We claim:

1. In a switching assembly which includes an insulative substrate upon which is carried a plurality of conductive paths respective portions of which are selectively bridged upon depression of a resilient conductive contact element, the improvement comprising:

said contact element being generally in the shape of a dome but having a central region of substantially planar conformation from which the remainder of said dome slants integrally downward and outward to a lower marginal rim portion;

and said dome-shaped element being disposed adjacent to said substrate with at least a portion of said rim portion being in electrical and physical contact with one of said portions of one of said paths, said central region being generally in registry over another of said portions in another of said paths to enable connection between said central region and that other portion upon depression of said central region.

2. An assembly as defined in claim 1 in which said remainder of said dome slants away from said central region at an angle of approximately eight degrees.

3. An assembly as defined in claim 1 in which said remainder includes an annular intermediate portion that slants away from said central region at a first angle and merges into said rim portion which slants with respect to said central region at a second angle greater than said first angle.

4. An assembly as defined in claim 3 in which said rim portion defines a foot that continues entirely around the lowermost margin of said dome.

5. An assembly as defined in claim 1 in which said contact element is secured to said substrate by an overlying layer of flexible insulating material, in which said layer includes means defining an aperture in registry with said element and said central region, and in which the diameter of said aperture is less than the diameter of said rim portion but is at least as large as the diameter of said central region.

6. An assembly as defined in claim 1 in which said other portions of said paths are segmented into separate areas underlying said element, and in which at least a portion of said separate areas are all at essentially the same level relative to said central region.

7. An assembly as defined in claim 6 in which said portions of said separate areas have been conjointly formed by depression of said areas into said substrate.

* * * * *